US005544827A

United States Patent [19]

Yano

[11] Patent Number: 5,544,827

[45] Date of Patent: Aug. 13, 1996

[54] AUTOMATIC COIL WINDER

[75] Inventor: Fumiharu Yano, Fukushima, Japan

[73] Assignee: Nittoku Engineering Kabushiki Kaisha, Saitama, Japan

[21] Appl. No.: 183,542

[22] Filed: Jan. 19, 1994

[30] Foreign Application Priority Data

Jan. 28, 1993 [JP] Japan ..... 5-012631

[51] Int. Cl.[6] ..... B21F 3/02

[52] U.S. Cl. ..... 242/445.100; 242/448

[58] Field of Search ..... 242/7.08, 7.09, 242/7.15, 7.14

[56] References Cited

U.S. PATENT DOCUMENTS 4,121,627 10/1978 Schmid ..... 242/7.09
4,558,835 12/1985 Sunaoka ..... 242/7.09
4,722,486 2/1988 Camardella ..... 242/7.09
4,725,017 2/1988 Carmardella ..... 242/7.09
4,966,337 10/1990 Fahrbach ..... 242/7.09
5,314,129 5/1994 Rivara ..... 242/7.09
5,397,070 3/1995 Yano ..... 242/7.09

*Primary Examiner*—Katherine Matecki
*Attorney, Agent, or Firm*—Jordan and Hamburg

[57] ABSTRACT

An automatic coil winder comprises a spindle on which a bobbin is mounted for rotation, and a nozzle for supplying a wire to the bobbin. The coil winder comprises a first arm and a second arm which move respectively in triaxial directions. The nozzle is supported on the first arm while a plurality of auxiliary tools are supported on the second arm. Two arms move the nozzle and the auxiliary tools independently, whereby the winding work to the bobbin can be efficiently carried out.

12 Claims, 5 Drawing Sheets

AUTOMATIC COIL WINDER

FIELD OF THE INVENTION

This invention relates to an automatic coil winder which automatically winds a coil.

BACKGROUND OF THE INVENTION

All automatic coil winder which automatically winds a coil generally performs winding operation by supplying a wire from a nozzle to a rotating bobbin mounted on a spindle driven by a motor.

Furthermore, for manufacturing a coil for a switching transformer, there is provided various kinds of working tools around the spindle, such as a wire-holding tool for holding the wire at the right angle on the outer circumference of the bobbin which is generally required at the start and end of winding, a tiepin for temporarily binding the wire, a taping unit for winding a tape on the bobbin, a cutter for cutting the wire, and a mounting and dismounting tool for exchanging the bobbin on the spindle with new one.

However, since these tools are disposed around the spindle, the operation of these tools is often disturbed by each other and the working efficiency is therefore not high in such a coil winder.

Furthermore, since the position of these tools are fixed and each tool has a minimum mechanism to perform a specific operation, the coil winder of this kind generally lacks the ability to process different types or dimensions of coils.

SUMMARY OF THE INVENTION

Therefore, it is an object of this invention to provide a coil winder which can perform various kinds of operations efficiently while maintaining compactness and simplicity of construction.

In order to achieve the object, this invention provides an automatic coil winder comprising a spindle adapted to carry a bobbin, a motor for rotating the spindle, and a nozzle for supplying a wire to the bobbin for winding. The coil winder further comprises a first and second arms. Each arm is provided with a mechanism for moving the arm in three orthogonal directions. The nozzle is supported on the first arm and plurality of auxiliary tools are supported on the second arm.

Preferably, the auxiliary tools comprise a wire-holding tool for temporarily holding the wire on the outer circumference of the bobbin.

Also preferably, the auxiliary tools comprise a tiepin for temporarily binding the wire.

Also preferably, the auxiliary tools comprise a tool for mounting and dismounting the bobbin on and from the spindle.

According to another aspect of this invention, the winder is further provided with a cutter supported on the first arm for cutting the wire.

According to yet another aspect of this invention, the winder is further provided with a mechanism for rotating the nozzle by approximately 90 degrees between a position perpendicular to the axis of the spindle and a position parallel to the same.

According to yet another aspect of this invention, the winder is further provided with a taping unit for winding a tape on the bobbin. The taping unit is supported independently from each of the arms.

According to yet another aspect of this invention, the tool for mounting and dismounting the bobbin on and from the spindle is supported by the first arm, and at least one auxiliary tool is supported on the second arm.

The details as well as other features and advantages of this invention are set forth in the remainder of the specification and are shown in the accompanying drawings.

DETAILED DESCRIPTION OF THE PREFERRED EMBODIMENTS

Figure 1:
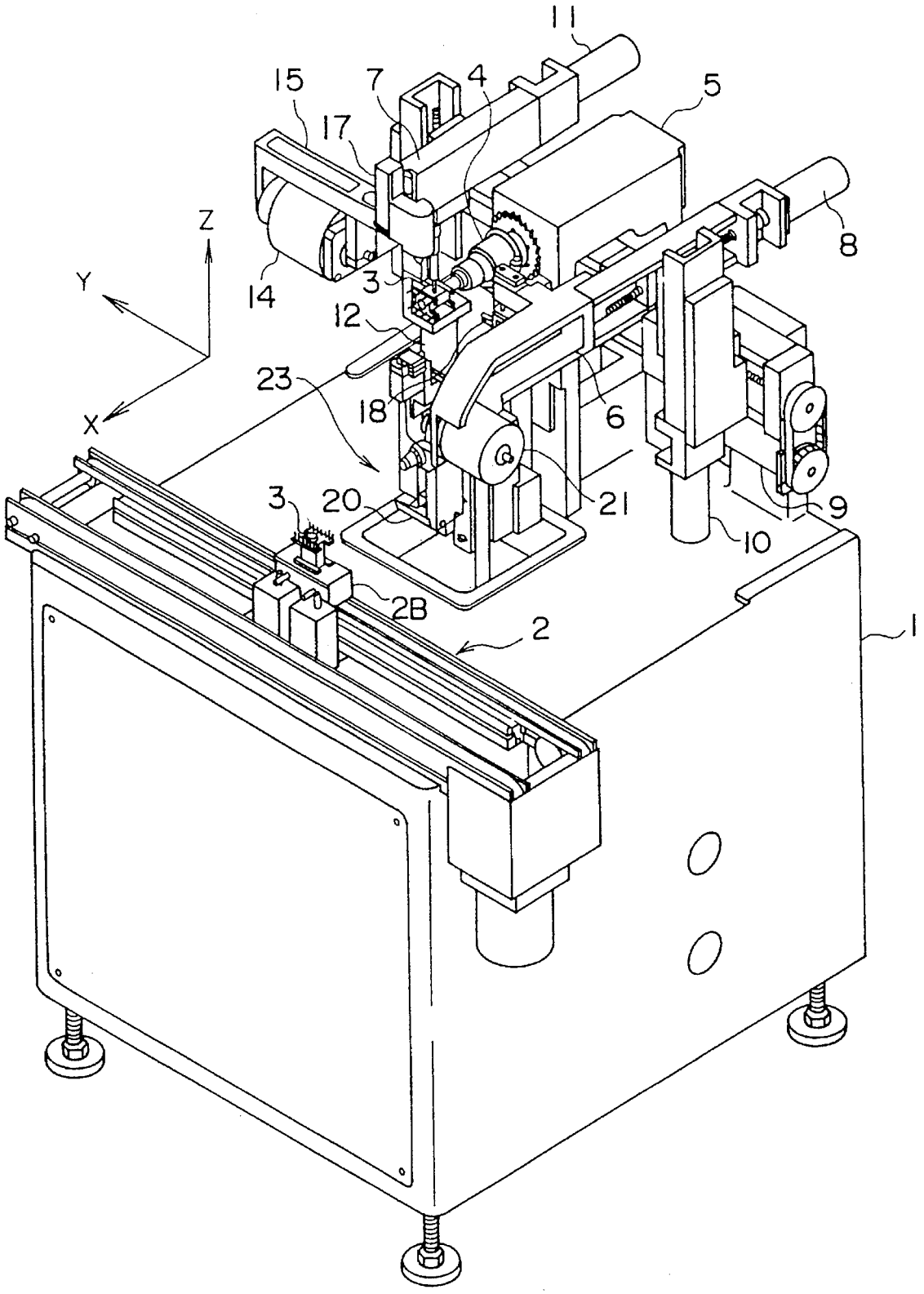
FIG. 1 is a perspective view of a coil winder according to this invention.

Referring to FIG. 1 of the drawings, a coil winder is provided on a base 1. A conveyor 2 having a holder 2B for conveying a bobbin 3 is provided between the winder and a storage place of the bobbin 3 not shown. The coil winder receives a bobbin 3 from the holder 2B to perform a coil winding, and delivers the bobbin 3 back to the holder 2B after the winding is completed.

Figure 2:
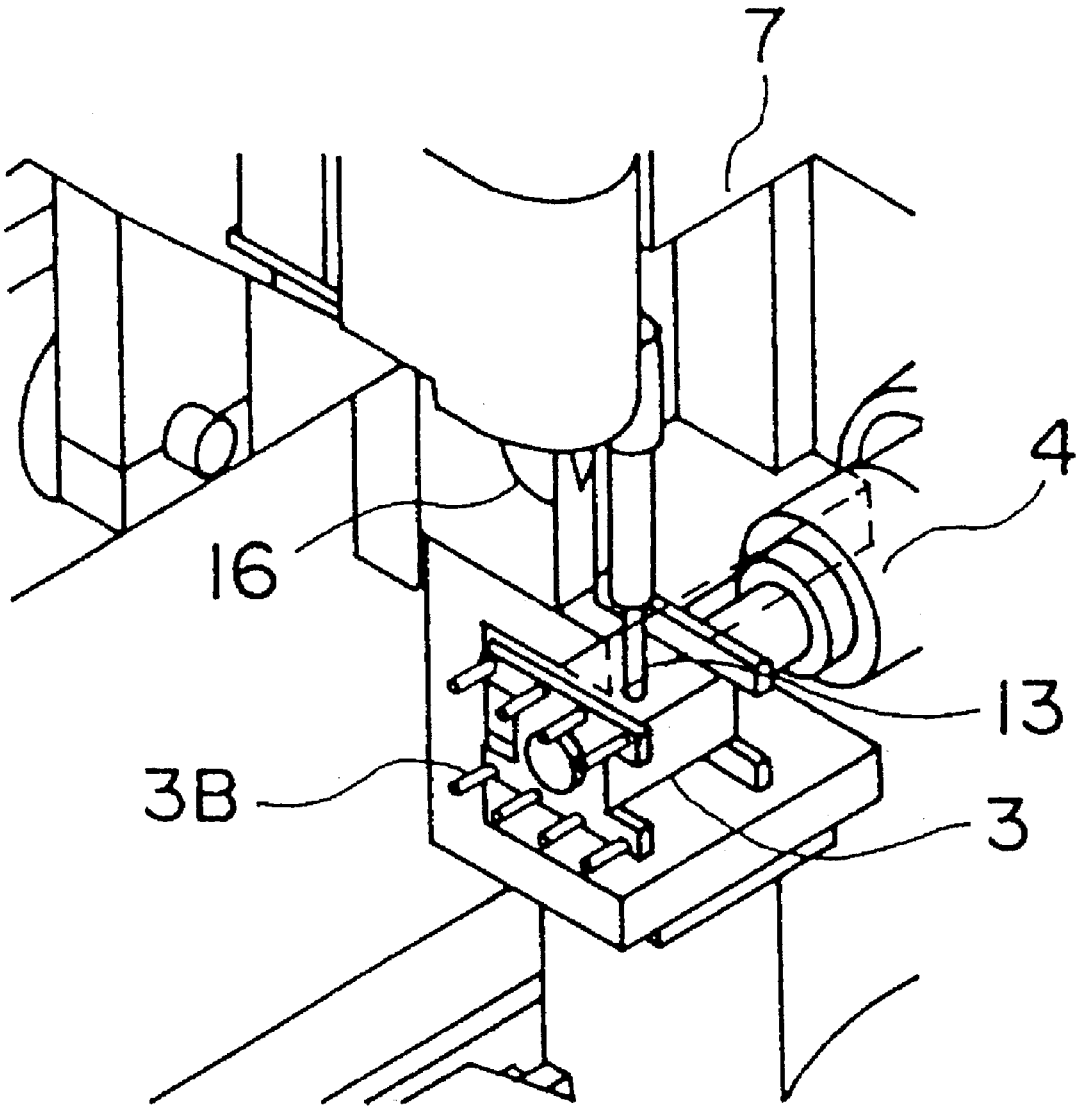
FIG. 2 is an enlarged view of a part of FIG. 1.

The bobbin 3 has terminals 3B shown in FIG. 2 on one side thereof in order to bind the wire at the beginning and end of winding.

The coil winder has a spindle 4 on which a bobbin 3 is mounted. The spindle 4 is driven by a motor not shown which is built in a motor housing 5 fixed to the base 1. The bobbin 3 is mounted on the spindle 4 and on the holder 2B via an intermediary member 3C shown in FIG. 4.

On both sides of the motor housing 5, the arms 6 and 7 are supported respectively on the base 1. Each arm is equipped with a drive mechanism moveable in three orthogonal directions.

The drive mechanism for the arm 6 is composed of an X-axis motor 8, a Y-axis motor 9 and a Z-axis motor 10. The drive mechanism for the arm 7 is composed of an X-axis motor 11, a Y-axis motor not shown and a Z-axis motor 12.

Figure 3:
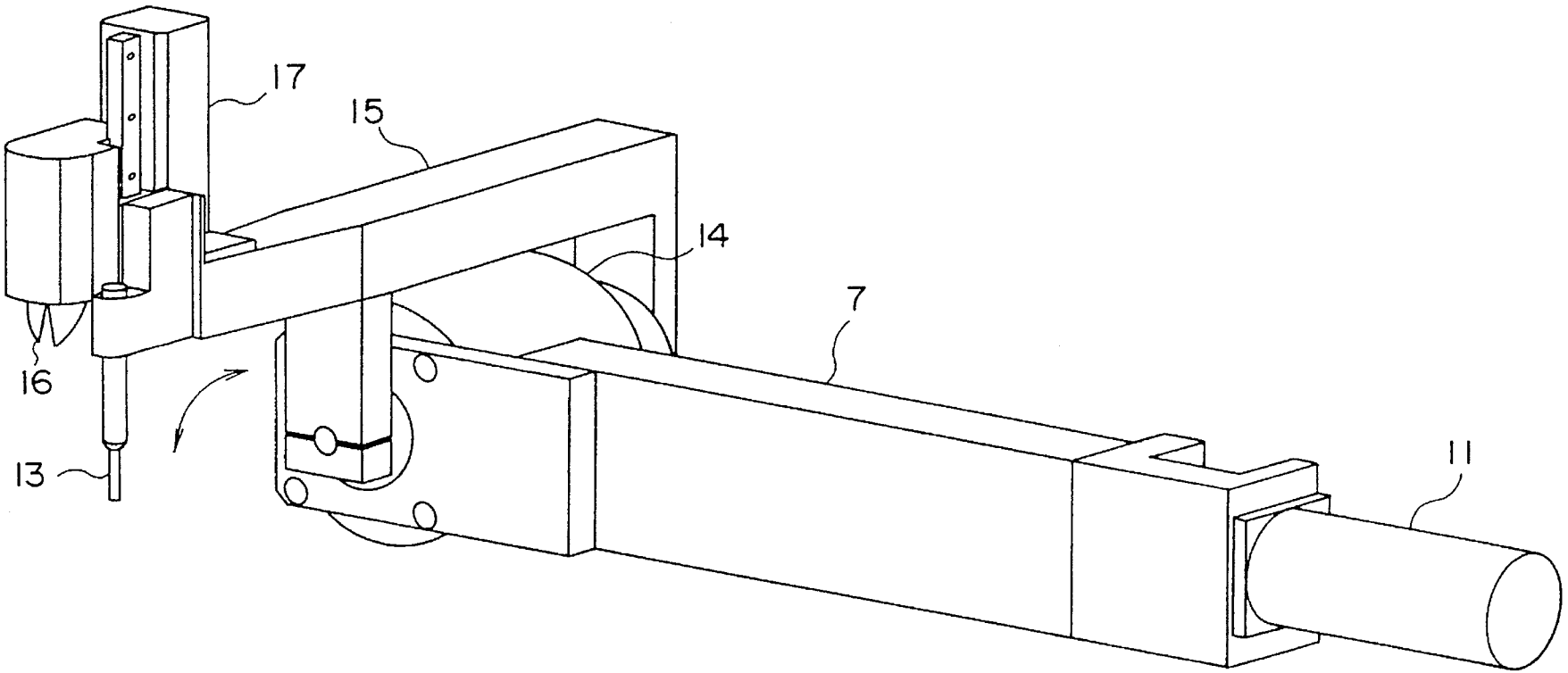
FIG. 3 is a perspective view of a first arm according to this invention.

At a tip of the arm 7, as shown in FIGS. 2 and 3, a nozzle 13 is supported via a rotary actuator 14 and a bracket 15. The rotary actuator 14 is actuated by an air pressure, having a rotation axis parallel to the Y-axis of FIG. 1, and rotates the nozzle 13 in the direction of an arrow shown in FIG. 3 in the range of approximately 90 degrees.

The nozzle 13 feeds the wire supplied from a wire supply device not shown from its tip to the bobbin 3. By tying an end of the wire to the bobbin 3 and by rotating the bobbin 3, the wire fed from the nozzle 13 is wound onto the bobbin 3.

A cutter 16 for cutting the wire is fitted to the bracket 15 on the side of the nozzle 13. The cutter 16 has a cylinder 17 for vertically reciprocating a cutter blade.

Figure 4:
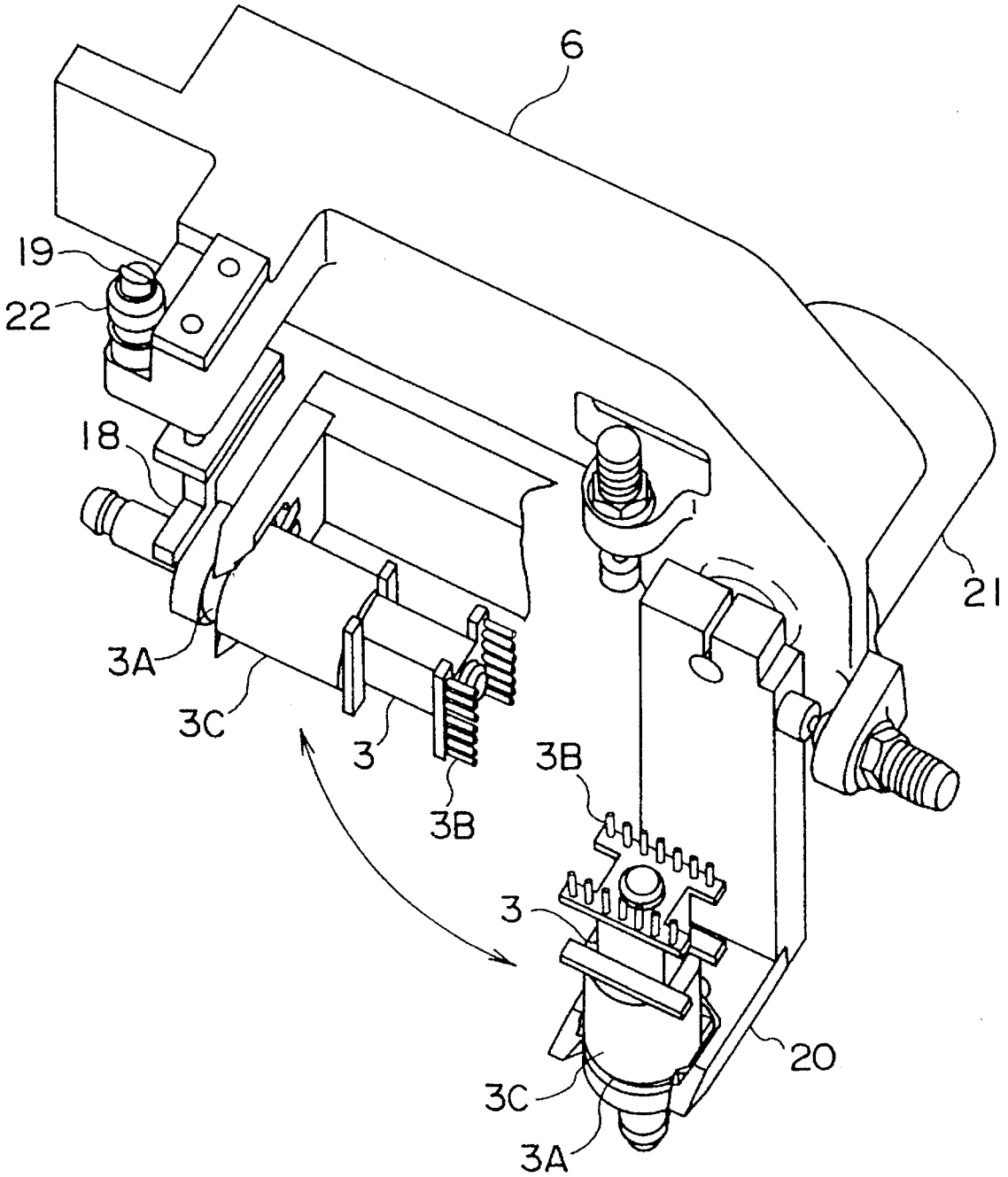
FIG. 4 is a perspective view of a second arm according to this invention.

On the arm 6, a wire-holding tool 18 and a tiepin 19 are fitted on the side near the base as shown in FIG. 4. The wire-holding tool 18 is a member projecting horizontally from the arm 6 toward the spindle 4. The tiepin 19 is a rod-like member projecting upward from the arm 6, having a notch in a V shape on the upper end thereof for binding the wire. A wire-discharge sleeve 22 is fitted over the outer surface of the tiepin 19. The wire-discharge sleeve 22 slides vertically along the tiepin 19, driven by an air cylinder not shown, to push off the wire tied to the notch.

Furthermore, at the tip of the arm 6, a bobbin-transferring tool 20 is supported as a mounting and dismounting tool via a rotary actuator 21.

The rotary actuator 21 is actuated by an air pressure, having a rotation axis parallel to the Y-axis of FIG. 1, and rotates the bobbin-transferring tool 20 in the direction of an arrow shown in FIG. 4 in the range of approximately 90 degrees.

The bobbin-transferring tool 20 is formed in L shape as shown in FIG. 4, having a tip portion bent by 90 degree. The tip portion is formed in a U shape. The bobbin-transferring tool 20 holds the bobbin 3 by fitting the tip portion to a circular groove 3A formed on the intermediary member 3C fitted to the bobbin 3. It rotates the bobbin 3 between a vertical position and a horizontal position shown in FIG. 4 corresponding to the rotation or the rotary actuator 21.

Figure 5:
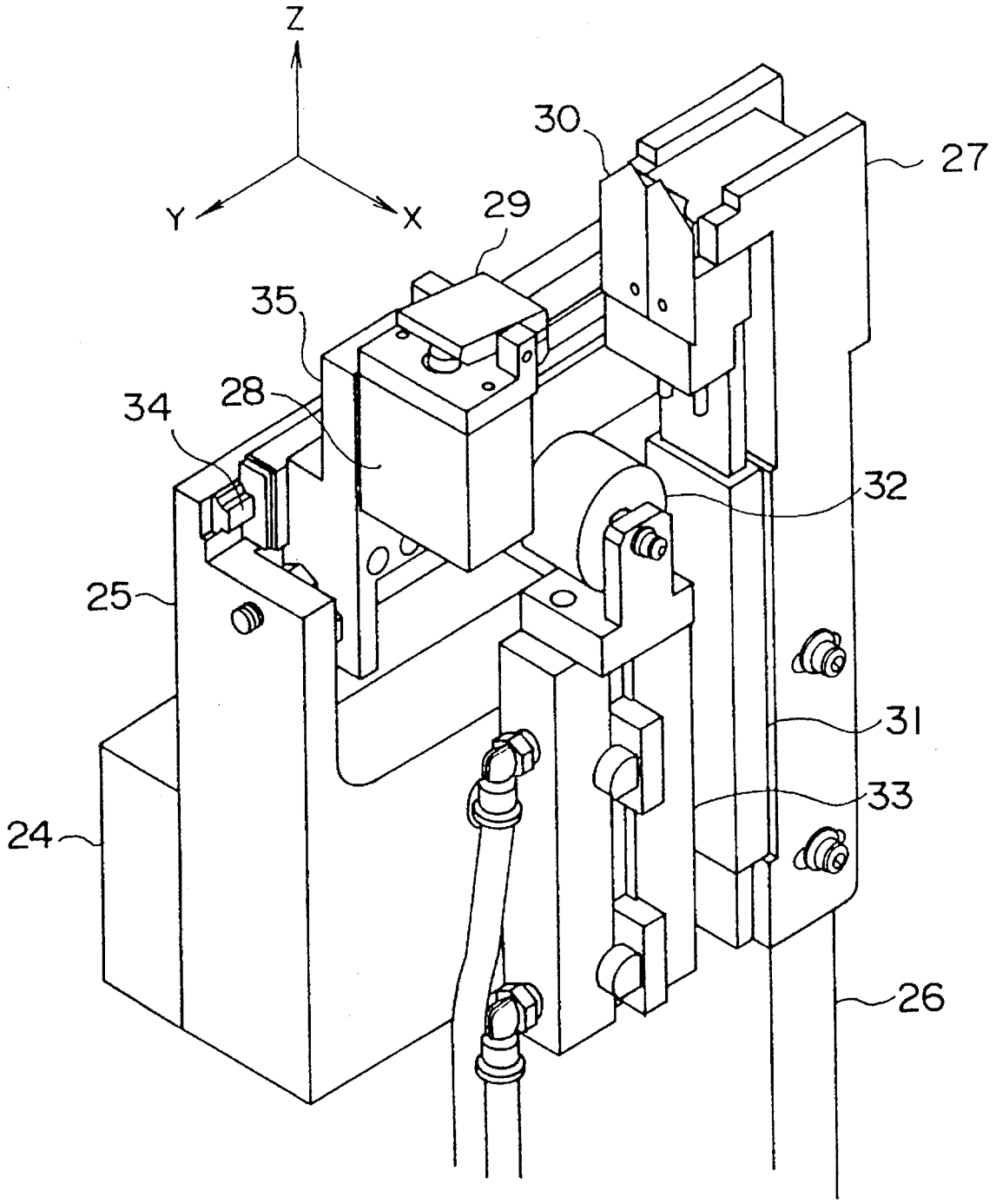
FIG. 5 is a perspective view of a taping unit according to this invention.

A taping unit 23 shown in FIG. 5 is disposed in the position below the spindle 4. The taping unit 23 is a mechanism for taping the bobbin 3, and is composed on a base member 25 which is supported by the motor housing 5 via a cylinder 24. The base member 25 moves vertically according to the elongation and contraction of the cylinder 24.

To the base member 25, is fixed a guide 27 having a longitudinal section in the reverse form of the L shape for guiding a tape 26. The tape 26 is fed from a tape reel not shown built in the base 1, and is guided upwards by this guide 27 and turned by 90 degrees to the horizontal direction at the bent portion of the guide 27.

A tape chuck 29 is mounted to the base member 25 via a chuck cylinder 28. The chuck cylinder 28 is supported by a horizontal cylinder not shown via a bracket 35. According to the elongation and contraction of the horizontal cylinder, the chuck cylinder 28 moves horizontally with the tape chuck 29 along the rail 34 fixed to the base member 25. This direction corresponds to the Y-axis shown in FIGS. 1 and 5. The tape chuck 29 opens and closes the tip directing to the guide 27 corresponding to the elongation and contraction of the chuck cylinder 28, and holds the end portion of the tape 26 guided by the guide 27.

At the end of the horizontal portion of the guide 27 is provided a cutter 30. The cutter 28 is displaced vertically corresponding to the elongation and contraction of a cylinder 31 mounted on the guide 27, and cuts the tape 26 between the guide 27 and the chuck 29.

On the base member 25, a roller 32 is supported via a cylinder 33, in a position between the guide 27 and the chuck 29. The roller 32 moves along the Z-axis shown in FIGS. 1 and 5 corresponding to the elongation and contraction of the roller 33.

The cylinders 17, 24, 28, 31 and 33 are composed of air-pressure actuators which are respectively actuated by compressed air. It is also possible, however, to apply electric actuators for these cylinders. These actuators are respectively controlled by a controller not shown.

The winding is initiated by transferring the bobbin 3 from the holder 2B to the spindle 4. In FIG. 1, although two bobbins 3 are shown, i.e., one on the spindle 4 and the other one on the holder 2B, this is for the explanatory purpose and in the reality the bobbin 3 exists only in either position according to the working phase.

Transferring of the bobbin 3 is performed by using the bobbin-transferring tool 20 mounted on the arm 6. To use this tool, the arm 6 is moved towards the holder 2B by the operation of the motors 8, 9 and 10, and as shown in FIG. 4, the tip portion of the bobbin-transferring tool 20 is fitted to the circular groove 3A of the intermediary member 3C on the holder 2B. Then, the arm 6 is moved in the Z-axis direction to scoop up the bobbin 3 from the holder 2B, and the arm 6 is moved towards the motor housing 5 by the operation of the motors 8, 9 and 10. And as shown in FIG. 4, the bobbin-transferring tool 20 is then rotated by 90 degrees by the rotary actuator 21 to mount the bobbin 3 to the spindle 4 together with the intermediary member 3C.

On the tiepin 19 provided on the arm 6 is bound the end portion of the wire fed from the nozzle 13. Until the transferring of the bobbin 3 is completed, the arm 7 is moved integrally with the arm 6 to prevent the wire from being unnecessarily fed from the nozzle 13.

After mounting the bobbin 3 to the spindle 4, the arm 6 moves along the Y-axis in the direction going away from the bobbin 3, detaches the bobbin-transferring tool 20 from the intermediary member 3C, and the rotary actuator 21 rotates the bobbin-transferring tool 20 to the vertical position.

Next, winding to the bobbin 3 is carried out. The nozzle 13 is rotated to the horizontal position, i.e., parallel to the spindle 4, by the rotary actuator 14, and the wire, of which one end has been bound to the tiepin 19, is bound to the terminal 3B of the bobbin 3 by moving the arm 7. For this, an X-axis motor 11, a Z-axis motor 12 and Y-axis motor not shown are operated.

After the wire is bound to the terminal 3B of the bobbin 3, the rotary actuator 14 rotates the nozzle 13 in the vertical position, i.e., perpendicular to the spindle 4. The cutter 16 is then driven by the cylinder 17 to cut the wire at a position near the terminal 3B between the tiepin 19 and the terminal 3B. Since the cutter 16 is positioned near the nozzle 13, the cutting can be carried out without moving the arm 7 largely. The chip of the wire remained on the tiepin 19 is removed by the wire-discharge sleeve 22.

The arm 7 then moves to place the nozzle 13 at a winding starting position, as a result of which the wire extends axially from the terminal 3B.

The arm 6 is then moved to apply the wire-holding tool 18 for holding the wire on the outer circumference of the bobbin 3. After the wire is held on the outer circumference of the bobbin 3, the nozzle 13 is again rotated to the horizontal position and then travels around the bobbin 3. As a result, a bent of the wire by approximately 90 degrees is formed at the position of the wire-holding tool 18, and this bent portion is fixed to the outer surface of the bobbin 3 by the wire having travelled around the bobbin 3.

The arm 6 is now moved to withdraw the wire-holding tool 18 from the bobbin 3 and the nozzle 13 is rotated back to the vertical position.

In this state, the spindle 4 starts rotating and the wire fed from the nozzle 13 is wound to the bobbin 3. Moving the nozzle 13 little by little in the Y-axis direction makes the wire wound equally on the bobbin 3.

When the predetermined number of wiring is completed, the rotation of the spindle 4 is stopped, the taping unit 23 is elevated, and the tape 26 is sticked on the bobbin 3. Prior to this work, the end portion of the tape 26 is held by the tape chuck 29 and the tape 26 is pulled out horizontally from the guide 27 by moving the tape chuck 29.

As the tip of the tape is sticked on the bobbin 3, the tape chuck 29 is released and the bobbin 3 is rotated to wind the tape 26 to the bobbin 3. After the tape 26 is wound on the bobbin 3 for more than a one round, the tape 26 is cut by the cutter 30, and the end portion of the tape 26 is pressed to the outer circumference of the bobbin 3 by raising the roller 32.

Now, the arm 6 is moved to hold the wire coming out of the end of the tape 26 with the wire-holding tool 18. The nozzle 13 is then moved in the axial direction toward the terminal 3B for binding the wire to another terminal 3B. This binding is carried out by the nozzle 13 rotated to the horizontal position.

After binding the wire to the terminal 3B, the nozzle 13 is rotated back to the vertical position, and the nozzle 13 is moved to bind the wire to the tiepin 19 on the arm 6. The wire extending from the terminal 3B of the bobbin 3 to the tiepin 19 is then cut by the cutter 16 at a position near the terminal 3B. Binding the wire to the tiepin 19 is preferably performed near the terminal 3B in order to minimize the loss of the wire.

The wire winding onto the bobbin 3 is now completed. If plural layers of coils are required, the wire winding and the taping are carried out alternately.

After the completion of the entire process, the bobbin-transferring tool 20 is rotated to the horizontal position, and the tip portion of the bobbin-transferring tool 20 is inserted to the circular groove 3A of the intermediary member 3C by the movement of the arm 6 in the Y-axis direction. Then, the arm 6 is moved in the X-axis direction to pull out the bobbin 3 from the spindle 4. The delivery tool 20 is rotated to the vertical position and then arm 6 is moved toward the holder 2B. After the intermediary member 3C is fitted to the holder 2B, the bobbin-transferring tool 20 is withdrawn.

The holder 2B on the conveyor 2 transfers the bobbin 3 of which winding has been completed to the storage place and conveys a new bobbin 3 to the base 1. Then the coil winder repeats the above-mentioned process again for the new bobbin 3. Thus, by driving the arms 6 and 7 and the taping unit 23 alternatively or in combination, the manufacturing of the coil including the wire winding is efficiently carried out.

Furthermore, since tools such as the nozzle 13, the cutter 16, the wire-holding tool 18, the tiepin 19 and the bobbin-transferring tool 20 are mounted on the arms 6 and 7, each tool can be moved in the three-dimensional directions without providing a moving mechanism to respective tool. With such a construction, the tools can be moved to the optimum position for the operation required, the time required for the process is short and various bobbins of different types and sizes can be processes. Moreover, since these tools can be put aside when they disturb the operation of other tools, it is not necessary to move the spindle 4 for the operation of any tools, which makes the required space for the winder small.

With regard to the arrangement of the tools for the arms 6 and 7, various design modifications are possible, for example, the bobbin-transferring tool 20 may be supported on the arm 6, or the bobbin-transferring tool 20 may be provided both on the arm 6 and the arm 7 to perform the delivery of the bobbin 3 to the holder 2B and receiving a new bobbin 3 from the holder 2B in parallel. It is also possible to provide a tool changer for exchanging the tool provided on the arm 6 and the arm 7.

The embodiments of this invention in which an exclusive property or privilege is claimed are defined as follows:

1. An automatic coil winder comprising:

a base;

a spindle adapted to carry a bobbin;

a motor on said base for rotating said spindle;

a nozzle for supplying a wire to said bobbin for winding;

a first arm moveable along three orthogonal axes;

means on said base for moving said first arm along each of said three orthogonal axes, said nozzle being supported on said first arm;

a second arm means for moving said second arm along each of the last said three orthogonal axes; and auxiliary tool means supported on said second arm.

2. An automatic coil winder according to claim 1, wherein said bobbin has an outer circumference, said auxiliary tool means comprises a wire-holding tool for temporarily holding said wire on the outer circumference of said bobbin.

3. An automatic coil winder according to claim 1, wherein said auxiliary tool means comprises a tiepin for temporarily binding said wire.

4. An automatic coil winder according to claim 1, wherein said auxiliary tool means comprises a tool for mounting and dismounting said bobbin on and from said spindle.

5. An automatic coil winder comprising:

a base;

a spindle adapted to carry a bobbin;

a motor on said base for rotating said spindle;

a nozzle for supplying a wire to said bobbin for winding;

a first arm moveable along three orthogonal axes;

means on said base for moving said first arm along each of said three orthogonal axes, said nozzle being supported on said first arm;

a cutter for cutting said wire, said cutter being supported on said first arm;

a second arm moveable along three orthogonal axes;

means for moving said second arm along each of the last said three orthogonal axes; and auxiliary tool means supported on said second arm.

6. An automatic coil winder comprising:

a base;

a spindle adapted to carry a bobbin, said spindle having an axis;

a motor on said base for rotating said spindle;

a nozzle for supplying a wire to said bobbing for winding;

a first arm moveable along three orthogonal axes;

means for moving said first arm along each of said three orthogonal axes, said nozzle being supported on said first arm;

means on said first arm for rotating said nozzle by approximately 90 degrees between a position perpendicular to said axis and a position parallel to said axis, a second arm moveable along three orthogonal axes;

means for moving said second arm along each of the last said three orthogonal axes, and auxiliary tool means supported on said second arm.

7. An automatic coil winder comprising:

a base;

a spindle adapted to carry a bobbin;

a motor for rotating said spindle;

a nozzle for supplying a wire to said bobbin for winding;

a first arm moveable along three orthogonal axes;

means for moving said first arm along each of said three orthogonal axes, said nozzle being supported on said first arm;

a second arm moveable along three orthogonal axes;

means for moving said second arm along each of the last said three orthogonal axes, a plurality of auxiliary tools supported on said second arm; and a taping unit on said base for winding a tape on said bobbin, said taping unit being supported independently from each of said arms.

8. An automatic coil winder comprising:

a base;

a spindle adapted to carry a bobbin;

a motor for rotating said spindle;

a nozzle for supplying a wire to said bobbin for winding;

a first arm moveable along three orthogonal axes;

means for moving said arm along each of said three orthogonal axes, said nozzle being supported on said first arm;

a tool for mounting and dismounting said bobbin on and from said spindle, said mounting and dismounting tool being supported on said first arm, a second arm moveable along three orthogonal axes;

means for moving said second arm along each of the last said three orthogonal axes, and at least one auxiliary tool supported on said second arm.

9. An automatic coil winder according to claim 8, wherein said bobbing has an outer circumference, said auxiliary tool being a wire-holding tool for temporarily holding said wire on the outer circumference of said bobbin.

10. An automatic coil winder according to claim 8, wherein said auxiliary tool is a tiepin for temporarily binding said wire.

11. An automatic coil winder comprising:

a base;

a spindle adapted to carry a bobbin;

a motor on said base for rotating said spindle;

wire supply means for supplying a wire to said bobbin for winding;

a first arm moveable along three orthogonal axes;

means on said base for moving said first arm along each of said three orthogonal axes, said wire supply means being supported on said first arm;

a second arm moveable along three orthogonal axes;

means for moving said second arm along each of the last said three orthogonal axes; and auxiliary tool means supported on said second arm.

12. An automatic coil winder further comprising means for mounting said motor and said spindle in a fixed position on said base.

* * * * *